United States Patent [19]

Stromberger et al.

[11] Patent Number: 4,881,472

[45] Date of Patent: Nov. 21, 1989

[54] IGNITION SYSTEM AND CONTROL MEANS FOR PELLETIZED-FUEL FURNACE

[75] Inventors: Thomas Stromberger; Douglas Freeland, both of Spokane, Wash.; Dwain Freeland, Spirit Lake, Id.

[73] Assignee: Deeze, Inc., Spokane, Wash.

[21] Appl. No.: 260,446

[22] Filed: Oct. 20, 1988

[51] Int. Cl.[4] ..... F23N 5/18

[52] U.S. Cl. ..... 110/186; 110/101 C; 110/190; 110/193; 110/349

[58] Field of Search ..... 110/185, 186, 101 C, 110/191, 190, 193, 233, 102, 349; 126/25 B

[56] References Cited

U.S. PATENT DOCUMENTS

| | | | |
|---|---|---|---|
| 461,327 | 10/1891 | Dixon . | |
| 1,964,614 | 6/1934 | Williams | 126/182 |
| 2,210,720 | 8/1940 | Johnson et al. | 110/349 |
| 2,967,495 | 1/1961 | Haan | 110/22 |
| 3,902,436 | 9/1975 | Turner | 110/103 |
| 3,926,582 | 12/1975 | Powell | 48/62 |
| 4,201,141 | 5/1980 | Teodorescu | 110/259 |
| 4,203,374 | 5/1980 | Frederick | 110/258 |
| 4,213,404 | 7/1980 | Spaulding | 110/229 |
| 4,257,338 | 3/1981 | Chasek | 110/341 |
| 4,312,278 | 1/1982 | Smith et al. | 110/234 |
| 4,377,117 | 3/1983 | Kolze | 110/248 |
| 4,395,956 | 8/1983 | Hand, Jr. | 110/235 |
| 4,430,949 | 2/1984 | Ekenberg | 110/193 |
| 4,446,800 | 5/1984 | Lovgren | 110/270 |
| 4,454,827 | 6/1984 | Smith et al. | 110/234 |
| 4,454,828 | 6/1984 | Zempel | 110/248 |
| 4,484,530 | 11/1984 | Goetzman . | |
| 4,669,396 | 6/1987 | Resh | 110/233 |
| 4,782,765 | 11/1988 | Miller et al. | 110/186 |

*Primary Examiner*—Edward G. Favors

*Attorney, Agent, or Firm*—Mark W. Hendricksen

[57] ABSTRACT

A furnace system for the automatic, continuous and efficient ignition and combustion of pelletized or similar fuel. An electric-arc ignition means responsive to a thermostat is combined with a non-conductive refractory fire pot with air passageways on the bottom surface of the fire pot, two electrodes configured relative to said fire pot and a system control means, for controlling and sequencing the operation of the system elements. A system control means is also disclosed which de-energizes the fuel feed device if the temperature in the combustion chamber exceeds a pre-determined value, automatically re-energizes the fuel feed device once the temperatue falls back within acceptable levels, and which de-energizes the fuel feed device if the temperature measured in the combustion chamber falls below a pre-determined value.

5 Claims, 8 Drawing Sheets

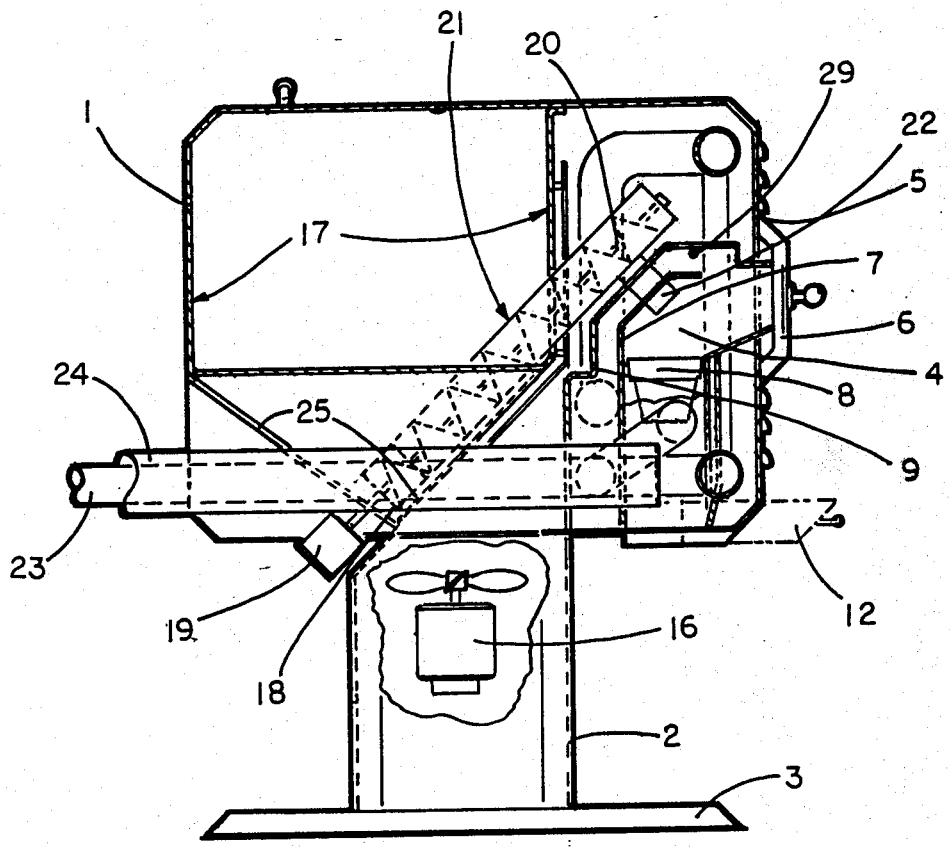
FIGURE 1
FIGURE 2
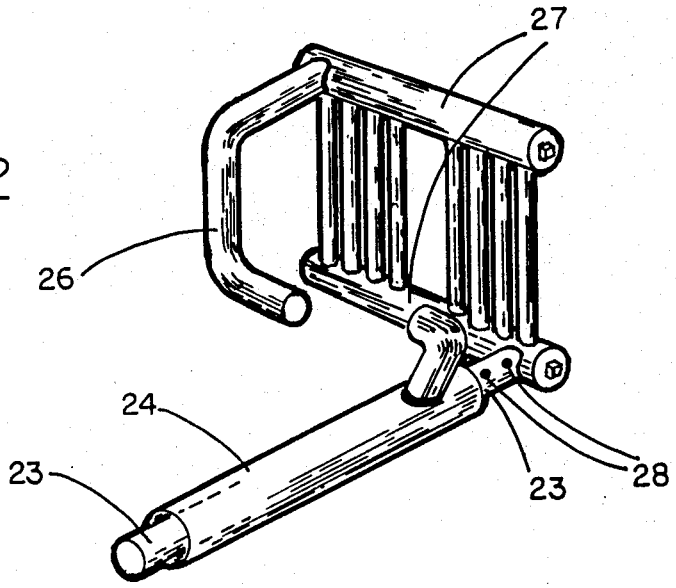

IGNITION SYSTEM AND CONTROL MEANS FOR PELLETIZED-FUEL FURNACE

BACKGROUND OF INVENTION

1. Field of the Invention

This invention generally relates to a new and improved ignition system and control system for automatically, efficiently and economically igniting, combusting and controlling the temperature of a heating furnace or stove which utilizes pelletized and similar fuels.

2. Description of the Prior Art

For the years that pelletized or fragmented fuel has been combusted in independent, space-heating residential furnaces, there have not been sufficient means employed or developed which provide an automatic means for igniting and controlling the temperature of the furnace and which efficiently and economically combust pelletized or fragmented fuel of differing heating capacities. In addition to the frequent human intervention and frequent maintenance requirements of prior art, the prior art systems employed in the industry result in unacceptable temperature variation in the space to be heated.

Conventional pelletized-fuel furnaces frequently require human intervention of some sort to ignite the fuel add thereby initiate the combustion process, and also require human intervention to stop or reduce the supply of heat to the area to be heated once the desired temperature is reached. Once ignition has occurred and once the desired temperature in the area to be heated has been reached, conventional pelletized-fuel furnaces and prior ar generally keep providing heat until someone turns the furnace off, or to low-burn or to the pilot-light cycle. The prior art in the industry generally must maintain some form of a continual pilot light or other method to maintain partial or minimum combustion to avoid additional human intervention to reignite the furnace when additional heat is again required. The avoidance of the need to continually and manually turn the furnace to a lower burn rate or completely off and then manually re-igniting, results in other problems, namely unacceptably high maintenance and unacceptable temperature variances.

Prior art has heretofore been unable to develop an economical and automatic heating furnace which has an acceptable automatic control system, which allows sufficient control over the temperature of the room to be heated and sufficient system control means over the furnace elements and operation.

The pellet-burning furnaces and prior art employed in the industry have an unacceptably high frequency for maintenance for several reasons. The first is that, because of the nature of the ignition means and the frequent human intervention requirements, prior art attempts to reduce the human intervention requirements by maintaining a continuous pilot light or low-burn cycle, even when the space to be heated is at or above the desired temperature. When the prior art furnaces operate in the low-burn cycle for an impermissibly long period of time, the temperature of the products of combustion are not sufficient to prevent condensation from accumulating throughout the furnace, including through the heat exchanger and in the ducts carrying the products of combustion through the furnace to the environment.

Another characteristic of the continuous pilot-light or low-burn cycle is that the combustion rate is lowered commensurate with the lower temperature, resulting in the products of combustion containing carbon which has not yet been combusted, or soot, which tends to stick to the condensation and form layers on the internal surfaces. This build-up of soot decreases the overall heating efficiency by inhibiting the function of heat exchanger, clogging the air ducts and consequently alters the air flow through the furnace, in addition to requiring substantially more maintenance. The internal build-up of soot also provides a source of combustion on the internal surfaces and thereby increases the chance of a fire starting other than in the combustion chamber in the furnace.

The pelletized-fuel furnace industry has heretofore been unable to develop an automatic and continuous furnace that is a relatively simple design to allow it to be sold economically to a larger portion of the public for residential use.

The failure of the prior art to maintain sufficient temperature control and failure to use an effective automatic ignition system has resulted in the prior art's inability to maintain the area to be heated at a constant, predictable and comfortable temperature. The result causes unacceptable temperature variation in the area heated and requires excessive maintenance.

Our invention has greatly reduced the high maintenance requirement to an extent the prior art and the industry have not been able to achieve. Our invention utilizes an electrical-arc ignition system to eliminate the need for a continuous low-burn cycle and utilizes a system control means that maintains the desired temperature, with much less variance.

Additionally, our invention, by eliminating the situation where the furnace continues to operate when the temperature in the combustion chamber is insufficient for a complete and efficient combustion, reduces the excessive soot content of the products of combustion and reduces the maintenance requirements.

Our invention has also reduced the required maintenance by limiting the duration of the low-burn cycle to 30 minutes, which we have found to be the time when the furnace temperatures cool down to a point where condensation and consequently soot may start to accumulate in the system and require additional maintenance.

Our invention, through its electrical-arc ignition system and system control means, is an automatic ignition and automatic operation pellet-burning furnace which maintains the temperature of the area to be heated much more comfortably through its electrical-arc ignition system and use of a typical wall-mounted thermostat.

Our invention, through the configuration of the electrodes and the electrodes relative location vis-a-vis the combustion fire pot, includes safety feature whereby the electrical-arc will not ignite the fuel in the fire pot if the circulation of the combustion air is insufficient or at a standstill.

Our invention is distinguished from prior art individually or any combination thereof by providing an apparatus which eliminates the problems relating to all prior art as discussed more fully herein.

SUMMARY OF THE INVENTION

Our invention generally provides an automatic pelletized-fuel furnace system with an electrical-arc ignition system, a system control means, and a system safety means for the automatic, continuous and efficient ignition and combustion of pelletized or similar fuel.

An object of our invention is to achieve a furnace which has a combustion chamber and fire pot capable of continuous operation at a higher temperature to obtain more complete combustion and reduce the amount of combustibles in the products of combustion.

An object of our invention is to provide an independent pelletized-fuel burning furnace with a simple, relatively inexpensive and automatic ignition means and automatic operational system.

A further object of our invention is to provide said furnace system with a much lower frequency of maintenance requirement than current systems in the industry and in prior art.

Another object of our invention is to provide said furnace system with a system control means which automatically and continuously monitors the temperature of the space to be heated and controls heat output of the furnace to achieve and maintain a predetermined temperature, within a much smaller variance than that of prior art.

A further object of our invention is to provide said furnace system with a system control means that maintains sufficient temperature controls so that the amount of condensation which accumulates through the heat exchanger and on the internal surfaces is greatly reduced and which operates at a higher combustion efficiency, and such that the adherence of the soot and/or fly-ash to the internal surfaces of the furnace is minimized. This results in a lower maintenance and safer furnace.

Another object of our invention is to provide said furnace with a system control means which interfaces and operatively connects the temperature monitoring and control means, the electrical-arc ignition system and the fuel feed system and which sequences the various elements of the invention for the efficient and safe operation the heating furnace.

A further object of our invention is to provide a system safety means which will reduce the probability that the furnace will cause a fire. Our invention accomplishes this through operative association of the temperature monitoring, the electrical-arc ignition system and the fuel feed system.

A further object of our invention is to provide a system safety means which will monitor the current or amperes to the combustion fan so that if the fan is inoperative or not operating at sufficient capacity, the auger fuel feed source will be be deenergized and the furnace will then turn itself off.

A further object of our invention is to provide a safety means which will not ignite the fuel if the circulation of the combustion air is insufficient or non-existent. Our invention accomplishes this by relative configuration of the fire pot and the electrical-arc electrodes in combination with the shape of the electrodes.

Other and further objects of our invention will appear from the specifications and accompanying drawings which form a part hereof. In carrying out the objects of our invention, it is to be understood that its essential features are susceptible to change in design and structural arrangement with only one practical and preferred embodiment being illustrated in the accompanying drawings, as is required.

BRIEF DESCRIPTION OF DRAWINGS

In the accompanying drawings which form a part hereof and wherein like numbers of reference refer to similar parts throughout:

FIG. 1 is a side view of pelletized-fuel furnace;

FIG. 2 is an orthogonal view of the heat exchanger manifold;

DESCRIPTION OF PREFERRED EMBODIMENT

Figure 3:
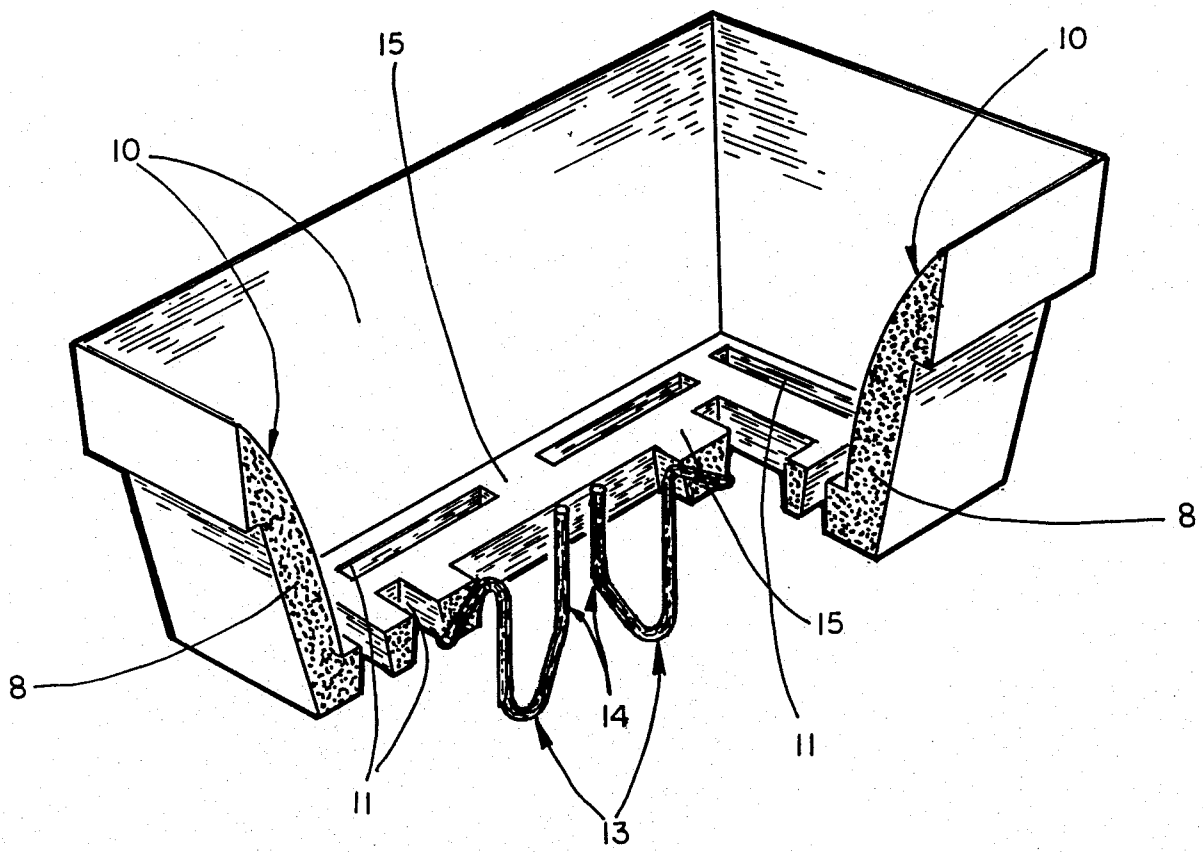
FIG. 3 is an orthogonal view of the fire pot and the electrodes.

Our invention generally provides a furnace system which automatically, continuously and efficiently ignites and combusts pelletized or similar fuel and which has an automatic operational phase to maintain a preselected temperature in the area to be heated.

Many of the fastening, connection and other means utilized in the invention are widely-known and used in the field of the invention described, and their exact nature or type is not necessary for an understanding and use of the invention by a person skilled in the art or science, and they will not therefore be discussed in significant detail.

FIG. 1 shows an independent pelletized-fuel furnace system. The furnace body 1 is approximately twenty-six inches wide, twenty inches in height and twenty-eight inches deep. The furnace body 1, constructed of nine-sixty-fourths inch sheet metal, is affixed to and supported by the furnace pedestal 2, which is also constructed of nine-sixty-fourths inch sheet metal. The furnace pedestal 2, which is approximately thirteen inches in height and ten and one-half inches wide and deep, is affixed to and combines with the pedestal base 3, to provide the furnace support means. The pedestal base is also nine-sixty-fourths inch sheet metal.

The combustion chamber 4, constructed of one-quarter inch sheet metal, is affixed to the furnace body 1 in the frontal portion of the furnace body 5 and a portion of it extends through an opening in the frontal portion of the furnace body 5 and forms a rectangular opening for attachment and operational connection of the combustion chamber door 6. The combustion chamber 4 is approximately twelve inches in height, six and one-half inches in width and eight inches in depth at its deepest location.

The combustion chamber 4 contains a stainless steel shield 7 which acts as an air separator for flow of the products of combustion into the heat exchange manifold. The shield is located between the fire pot 8 and the rear wall 9 of the combustion chamber 4, and the products of combustion flow behind the shield and into the heat exchanger manifold, and in the process, ash is separated from the other products of combustion and deposited into the ash drawer 12 below. This area behind the shield also acts somewhat as a secondary burn chamber or combustion chamber as additional combustion appears to occur therein and before the products of combustion are forced to the heat exchange area.

The combustion chamber door 6 is connected by hinged means to the combustion chamber 4 and is constructed of one-quarter inch steel, with a rectangular opening therein for insertion of high temperature-resistant glass to allow viewing the combustion fire without opening the combustion chamber door 6. The combustion chamber door 6 utilizes conventional means to secure the combustion chamber door 6 in the closed position.

FIG. 3 shows one example of the non-conductive, refractory fire pots 8 disclosed by this invention, and which serves as the means to contain and support the fuel during ignition and combustion. The fire pot 8 is formed by molding a non-conductive, refractory material into the desired shape or configuration for supporting the fuel during ignition and combustion. Although FIG. 3 shows the preferred embodiment of the fire pot 8 at the time of filing the application, there are many different variations in the specific size, configuration and shape of the fire pot 8, the walls and the openings in the bottom internal surface, that are also disclosed by this invention.

The necessary fire pot 8 elements include: refractory, non-conductive material, shaped generally to contain the fuel and for utilization of gravity combined with side walls of whatever configuration to guide pellets to the combustion area; a bottom surface with openings or air-ways for under-air combustion oxygen and an operational configuration of the electrical-arc ignition system with said fire pot 8.

FIG. 3 shows one rectangular-shaped example of a fire pot 8 disclosed by this invention, with internally sloped side-walls 10, similar to a hopper. The side walls 10 of the fire pot 8 act as a steep-walled funnel guiding the pellets to the combustion area.

The non-conductive, refractory fire pot can be constructed of material such as can be purchased from companies such as Pyrotek, of Spokane, WA, which is referred to as their "AR" material and can continually withstand temperatures of 2400 degrees Fahrenheit. Utilization of this or a similar type of material allows combustion temperatures of approximately 400 degrees Fahrenheit greater than those achieved in prior art, which utilizes a steel fire pot. On the bottom surface 15 of the fire pot 8 shown in FIG. 3 are rectangular-shaped openings 11, through which a portion of the solid products of combustion will fall and land in the ash collection drawer 12, which is located directly beneath said rectangular openings 11. The rectangular openings 11 at the bottom of the fire pot 8 also serve as inlets for the introduction of combustion under-air to the area of combustion.

This configuration of the electrodes 13 relative to the fire pot 8 gives our invention an added safety feature because it will prevent ignition of the fuel under conditions where there is insufficient or no combustion air circulation, such as an inadvertently open combustion chamber door, an insufficient combustion air supply due to the combustion fan not operating sufficiently, or other potential air circulation problems. This tends to prevent he furnace from overheating as a result of a number of different potential situations.

As shown in FIG. 3, the electrodes 13 are necessarily configured relative to the fire pot 8 by embedding them relative to the bottom surface 15 of the fire pot 8. The electrodes 13 are configured such that when the source of electricity is energized for ignition, an electrical-arc jumps across the gap between the two electrodes 13. As shown in the example in FIG. 3, the shortest distance between two points 14 on the two electrodes 13, occurs at a location 14 vertically lower than the bottom internal surface of the fire pot 8. The fundamental properties of electricity teach us that, assuming static air, the electrical-arc will occur between the two closest points on the electrodes 13. However, the combustion under-fire air drawn upward through the rectangular openings 11 in the fire pot 8 draws enough air through the opening to cause the arc to occur at a location vertically higher than it would if the air were not drawn through, and thereby causes the arc to rise above the bottom internal surface 15 of the fire pot 8 to contact and ignite the fuel.

The best mode at the time of filing, for configuring the electrodes 13 relative to the fire pot 8 is to affix the electrodes 13 to a combustion chamber wall, insulating them from said metallic wall with non-conductive tubing. The electrodes 13 could then be configured relative to one another such that one is bent at a 135 degree angle to the horizontal and in a direction away from its point of attachment to the combustion chamber wall and the other is bent 45 degrees back toward the other, thereby forming the gap between the two, and forming said gap at a point below the bottom surface 15 of the fire pot 8 so that the drawn combustion air must force the arc into the fuel to be ignited.

The ash collection drawer 12 is positioned directly beneath the rectangular openings 11 in the fire pot 8 and is operatively connected for interaction the furnace body 1 so that, from the front of the furnace, it can be manually pulled out like a drawer for ash removal.

As shown in FIG. 1, the fuel hopper 17, conventionally configured with internally sloped side-walls 25 is affixed to the furnace body 1 and contains the fuel. Also as shown in FIG. 1, the auger 20 transports the fuel from the bottom point 18 in the fuel hopper 17 for deposit into the combustion fire pot 8. The fuel hopper 17 also includes a fuel hopper lid, which is a sheet metal covering for the opening at the top of the hopper 17, for loading it with fuel.

The auger 20 is affixed to the fuel hopper 17 and is operatively connected to a conventional 120 volt AC auger motor 19, which is affixed to the furnace body 1. The auger 20 is contained within an auger tube 21, which extends from the bottom 18 of the fuel hopper 17 to an area above the combustion chamber 4 as shown in FIG. 1, and which comprises a hollow cylindrical tube with a fuel drop tube 22 affixed to it in the area above the combustion chamber.

The fuel drop tube 22 is a hollow cylindrical tube which acts as a conduit for transporting the fuel from the auger tube 21 into the refractory fire pot 8. The fuel drop tube 22 penetrates through an opening in the combustion chamber and penetrates through a heat baffle 7 within the combustion chamber, with the end of the fuel drop tube 22 being located directly above the refractory fire pot 8 so that fuel transported through the fuel drop tube 22 will fall directly into the fire pot 8 for combustion.

The furnace receives its combustion air and discharges it products of combustion through the use of a combustion fan which is located at the exit end of the exhaust pipe 23. The combustion air intake pipe 24 is a 3 inch diameter steel pipe which is concentric to the exhaust pipe, which is a 2 inch diameter pipe positioned within the intake pipe 24, but around the same axis. The combustion fan draws the combustion air by induction through the intake pipe 24, through the rectangular openings in the fire pot 8 and through the combustion chamber 4, into the inlet 26 to the heat exchange manifold 27, through the heat exchange manifold 27 and then out the exhaust pipe 23.

The incoming combustion air passes through the larger diameter air intake pipe 24, and just outside the surface of the exhaust pipe 23, which is located concentrically within the intake pipe 24. While passing over the exhaust pipe 23, the incoming combustion air receives heat therefrom and is thereby pre-heated by the temperature of the products of combustion passing through the exhaust pipe 23. The use of an outer intake pipe 24 gives this invention the added safety feature of eliminating the higher temperature exhaust pipe 23 from being exposed to potential human touch and potential fire hazards to which it may be exposed.

The incoming combustion air is drawn through the air intake pipe 24 to a location below the fire pot 8, where it is induced through the rectangular openings 11 in the bottom surface 15 of the fire pot 8, as combustion under-air. From the combustion chamber 4, the products of combustion enter the inlet pipe 26 to the heat exchange manifold 27, and then circulate through and heat the heat exchange manifold 27.

At the same time, the convection fan 16, which is mounted in the furnace pedestal 2, forces air across the exterior surface of the heat exchange manifold 27. The convection air receives heat from the heat exchange manifold 27 and is then circulated in the space to be heated. As shown in FIG. 2, the products of combustion then exit the heat exchange manifold 27 and enter the air exhaust pipe 23.

The convection fan 16, located in the furnace pedestal 2 has two speeds, and the speed at which it operates is controlled by two snap-switches 28 located on the heat exchange manifold 27. When the furnace is heating up, and the snap-switches 28 sense a temperature of 110 degrees Fahrenheit or greater, the convection fan 16 goes from off to its low speed speed, and when the temperature is then sensed to be at 170 degrees or greater, the convection goes to its high speed. When the furnace is cooling of and the temperature sensed by the snap switches drops down to or below 150 degrees Fahrenheit, the convection fan 16 speed is reduced to its low speed operation, and when the temperature is sensed to be at or below 90 degrees, the convection fan turns off. If the snap-switches 28 detect a temperature below 90 degrees Fahrenheit, they cutoff the power supply to the convection fan 16, to avoid circulating cooler air.

The system control means according to the invention monitors, sequences and controls the operation of the various elements of the furnace system, including, without limitation, the electrical-arc ignition means, the fuel feed means, the combustion fan, the thermocouple 29, the thermostat 44, and the convection fan 16.

The electrical-arc ignition system and system control means, according to this invention, use conventional wiring, circuitry and electrical components and devices which are widely-known and used in the field of the invention described, and their exact nature or type is not necessary for an understanding and use of the invention by a person skilled in the art or science, and they will not therefore be discussed in detail.

One example of an electrical-arc ignition means is shown in FIG. 3, in which the electrical-arc ignition system utilizes a voltage potential of approximately ten-thousand volts between the two electrodes 13. The specific amount of voltage utilized may be adjusted depending on the particular fuel burned and its moisture content. The ten-thousand volt potential across the electrodes 13 and the resultant current flow is achieved through the use of conventional voltage transformation means, which includes a voltage transformer with the primary windings at the typical household voltage of approximately one hundred twenty volts and the secondary windings set at approximately ten-thousand volts.

The electrical-arc jumps across the air gap between electrodes 13 and the recipient electrode is operatively connected back to the transformer and utilized as additional input to said transformer. The ignition process generally draws approximately 1.5 amperes of electrical current during its operation and generally takes approximately five minutes to obtain a sufficient and self-sustaining fire level.

The electrical-arc ignition means is conventionally connected to the transformer, which is conventionally connected to the typical 120 volt household outlet, with the energization and de-energization means controlled by the system control means, as set forth more fully herein.

Figure 4:
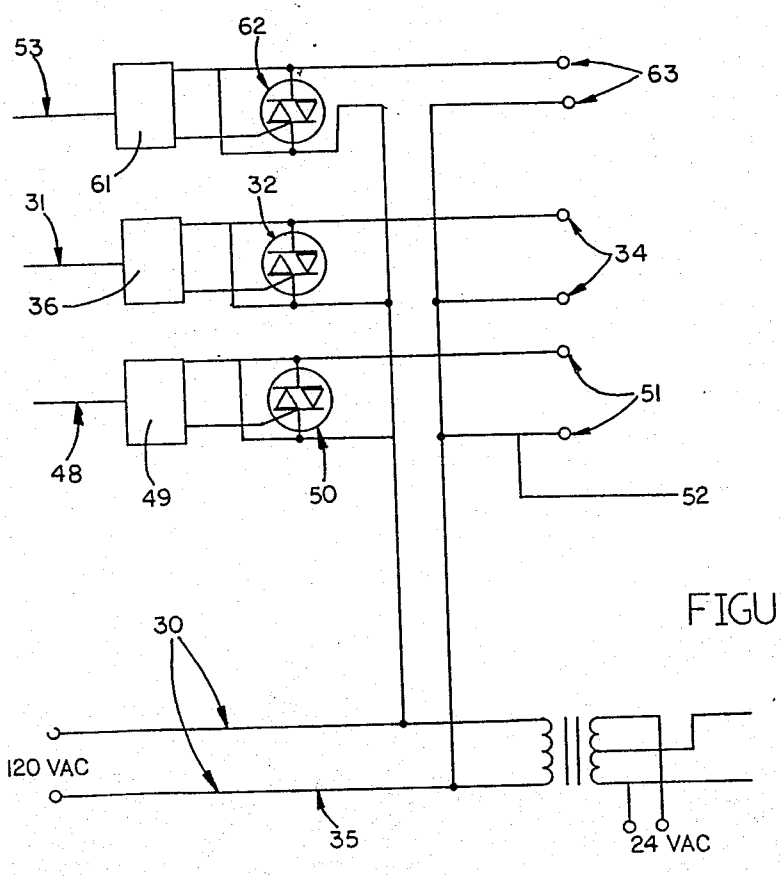
FIG. 4 is a summary circuit schematic diagram of the system control means output's operational association to the power supply and control of the components of the furnace system.
Figure 8:
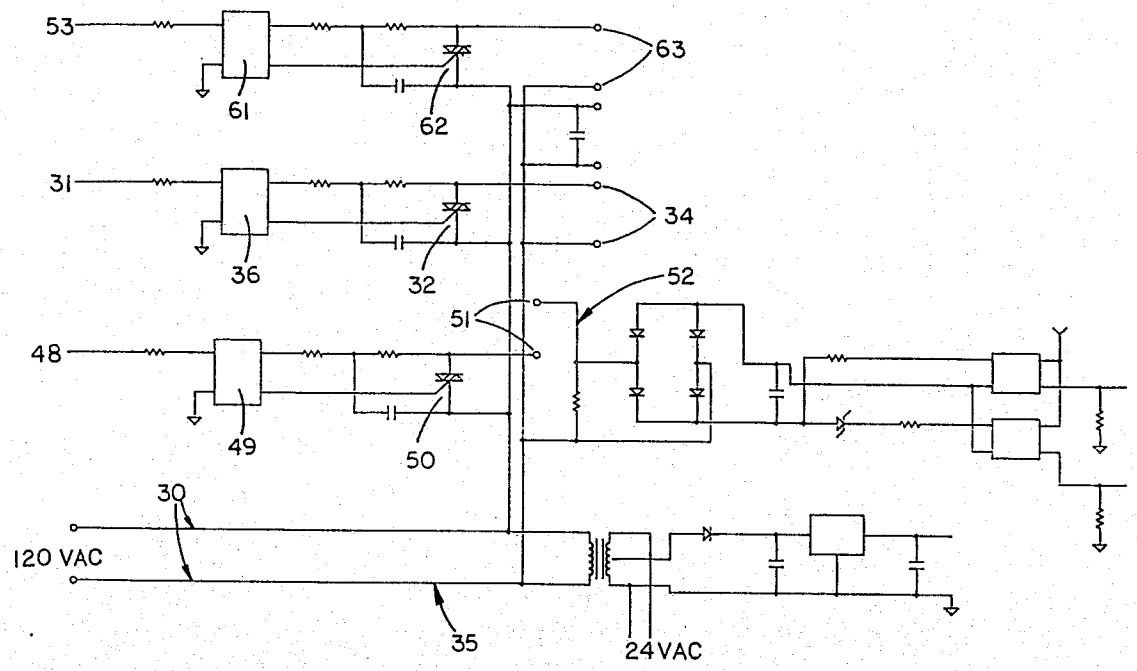
FIG. 8 is a more detailed circuit diagram of FIG. 4 showing one example of circuitry, which combined with FIG. 9, comprises a system control means as set forth more fully herein.

FIG. 4 shows one example and the preferred embodiment of the components of the power supply configuration relative to the system control means and FIG. 8 shows the circuit components in more detail. As shown in FIG. 4, the typical household electrical source 30, at approximately 120 VAC, serves as the power source for the furnace system, including the electrical-arc ignition means. Line 35 of said power source represents the neutral wire.

The system control means circuit output 31 for the electrical-arc ignition means is directed into a six pin, transistor output, opto-isolator 36, which utilizes an infra-red emitter/detector. As shown in FIG. 4, the opto-isolator 36 is operatively connected to a triac 32, which in turn, causes the energization of the terminals 34, which lead to the primary windings of the electrical-arc ignition transformer, and consequently energizes and creates the electrical-arc.

Figure 6:
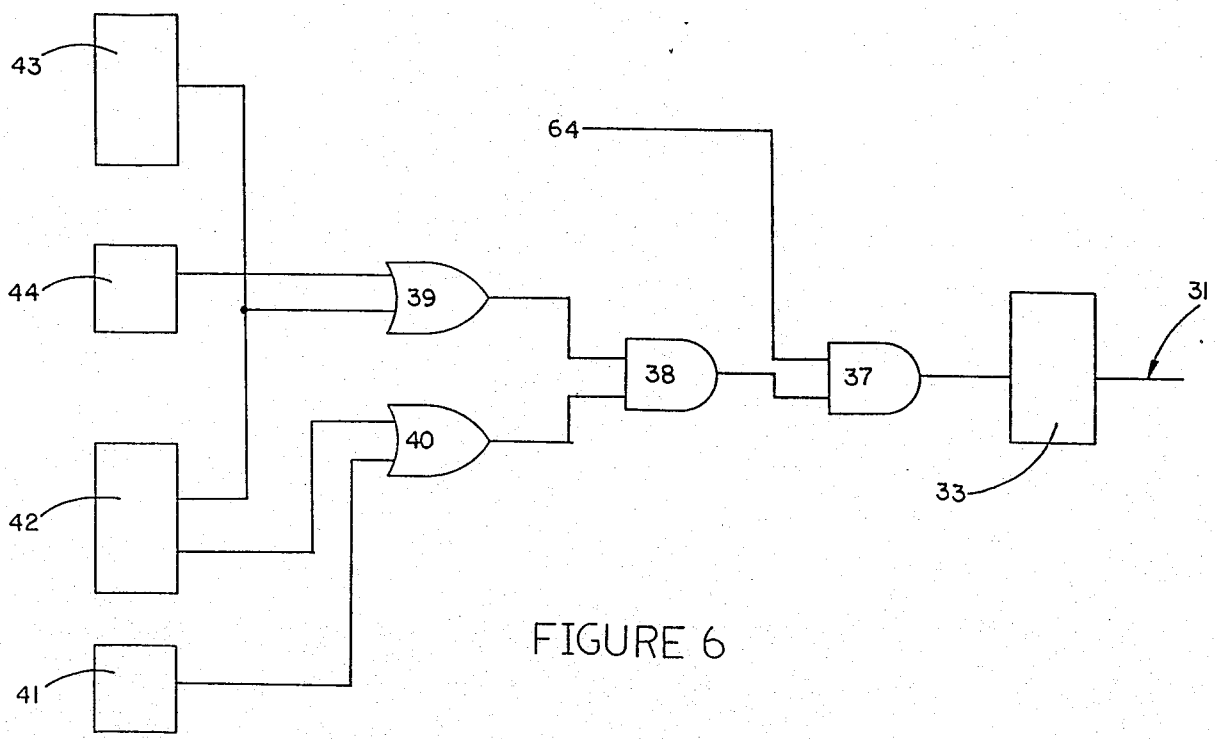
FIG. 6 is one summary example of a circuit diagram of the system control means for controlling the electrical-arc ignition means.
Figure 9:
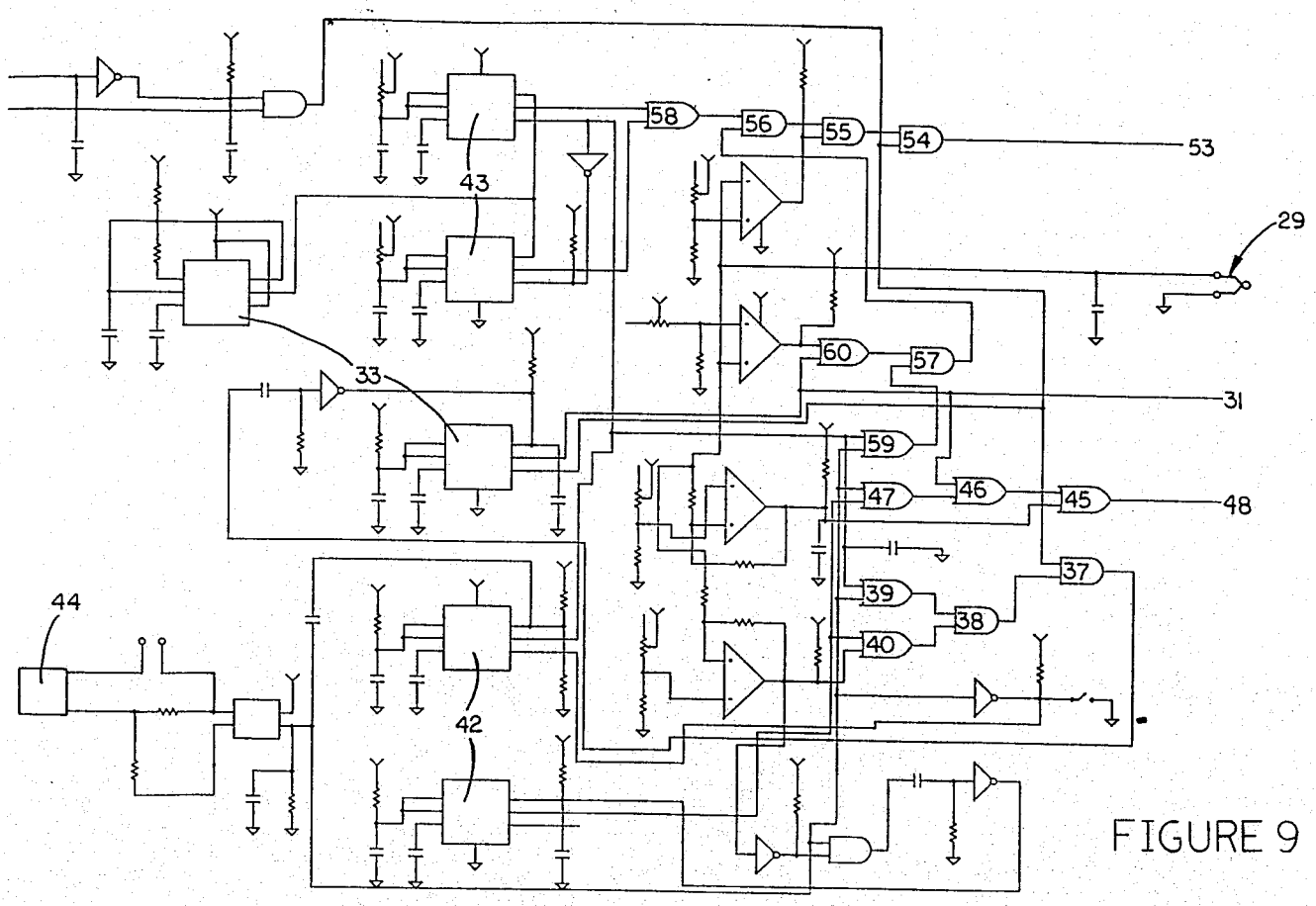
FIG. 9 is a more detailed circuit diagram of, without limitation, FIGS. 5, 6 and 7, showing one example of circuitry, which, when combined with FIG. 8, comprises a system control means as set forth more fully herein.

FIG. 6 shows the major components of the system control means for the electrical-arc ignition and FIG. 9 shows it in considerably more detail. In FIG. 6, the energization of the electrical-arc is controlled by a commonly used dual 555 timer chip 33, generally referred to as a "556 timer chip", which in turn, receives its input from the logic sequence shown in FIG. 6. The timer chip 33 will be energized if it receives positive output from and-gate 37 which will generate a positive output if it receives a positive input from and-gate 38 and from the output line 64 from the circuit monitoring the amperage to the combustion fan. A positive output from the circuit monitoring the amperage to the combustion fan indicates that the combustion fan is operating at a sufficient amperage level to indicate it is operating as planned.

And-gate 38 will generate a positive output if it receives positive input from or-gate 39 and from or-gate 40. Or-gate 40 will generate the positive output if it either receives a positive output from the LM-339 quad comparator 41 or a positive output from the timer chip 42. A negative signal from the quad-comparator 41 into or-gate 40 would indicate that the temperature measured by the thermocouple 29 in the combustion chamber 4 has fallen below approximately 364 degrees Fahrenheit. A positive signal from timer chip 42 indicates that the ten minute timer within timer chip 42 is operating. The ten minute timer is activated when the thermostat 44 calls for heat and the thermocouple 29 indicates, through the quad-comparator 41, that the temperature within the combustion chamber has dropped below approximately 364 degrees Fahrenheit.

Or-gate 39 will generate a positive signal if the thermostat 44 calls for more heat to the space to be heated or if either timer chip 43 or timer chip 42 indicates the furnace is in its low-burn cycle.

The LM-339 quad comparator 41 discussed above, receives its input from the type "K" thermocouple 29, located approximately ten inches above the fire pot 8 in the combustion chamber 4. The quad-comparator 41 makes four different logic level comparisons, depending on the level of the milli-volt reading being received from the thermocouple. The LM-339 quad comparator 41, a conventional quad comparator which can be readily purchased, is set and calibrated to logically compare milli-volt levels received from the thermocouple depending on the temperature sensed, at 2 mV, 7 mV, 7.5 mV and 34 mV.

The quad comparator 41 generates a positive logic output when the milli-volt level received reaches 2 mV, 7 mV and 7.5 mV, and generates a 0 or negative logic output when the milli-volt level measured reaches 34 mV. The quad comparator is calibrated such that the following readings in milli-volts approximately equate to the following temperature values at the thermocouple 29: 2 mV approximates 120 degrees Fahrenheit; 7 mV approximates 341 degrees Fahrenheit; 7.5 mV approximates 364 degrees Fahrenheit; and 34 mV approximates 1504 degrees Fahrenheit.

Figure 7:
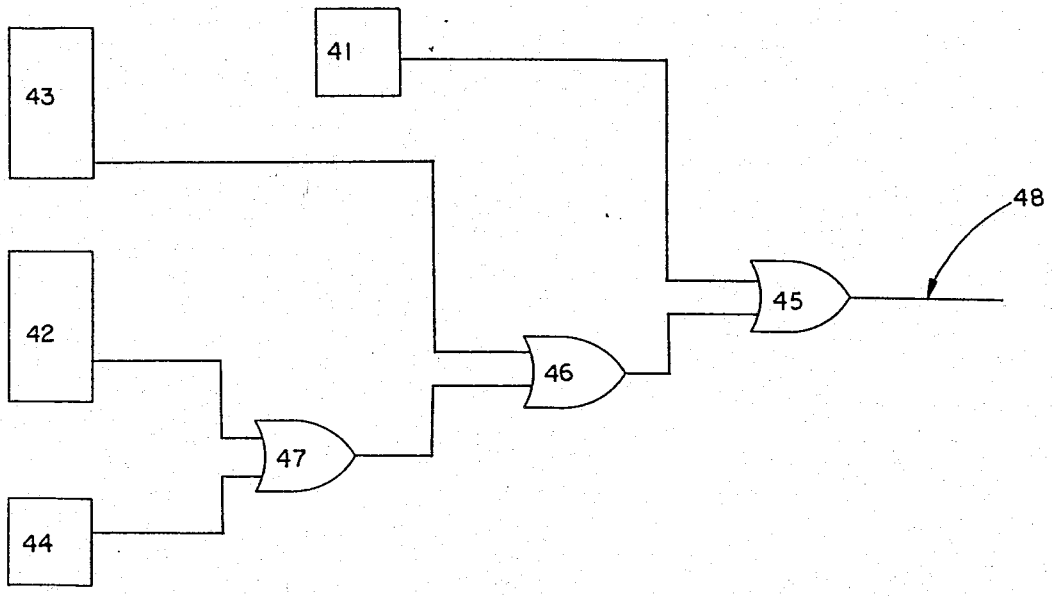
FIG. 7 is one summary example of a circuit diagram of the system control means for controlling the operation of the combustion fan.

FIG. 7 shows the major components of the system control means for the monitoring, operation and control of the combustion fan, and FIG. 9 shows it within the more comprehensive circuit diagram. FIG. 4 shows the output line 48 from the circuit shown on FIG. 7 entering the opto-isolator 49 and then the triac 50, which serve as the circuit cutout means for energizing and de-energizing the combustion fan. The power to the combustion fan is across terminals 51 and line 52 connects to the circuit which monitors the amperage to the combustion fan, as shown in FIG. 8.

Figure 5:
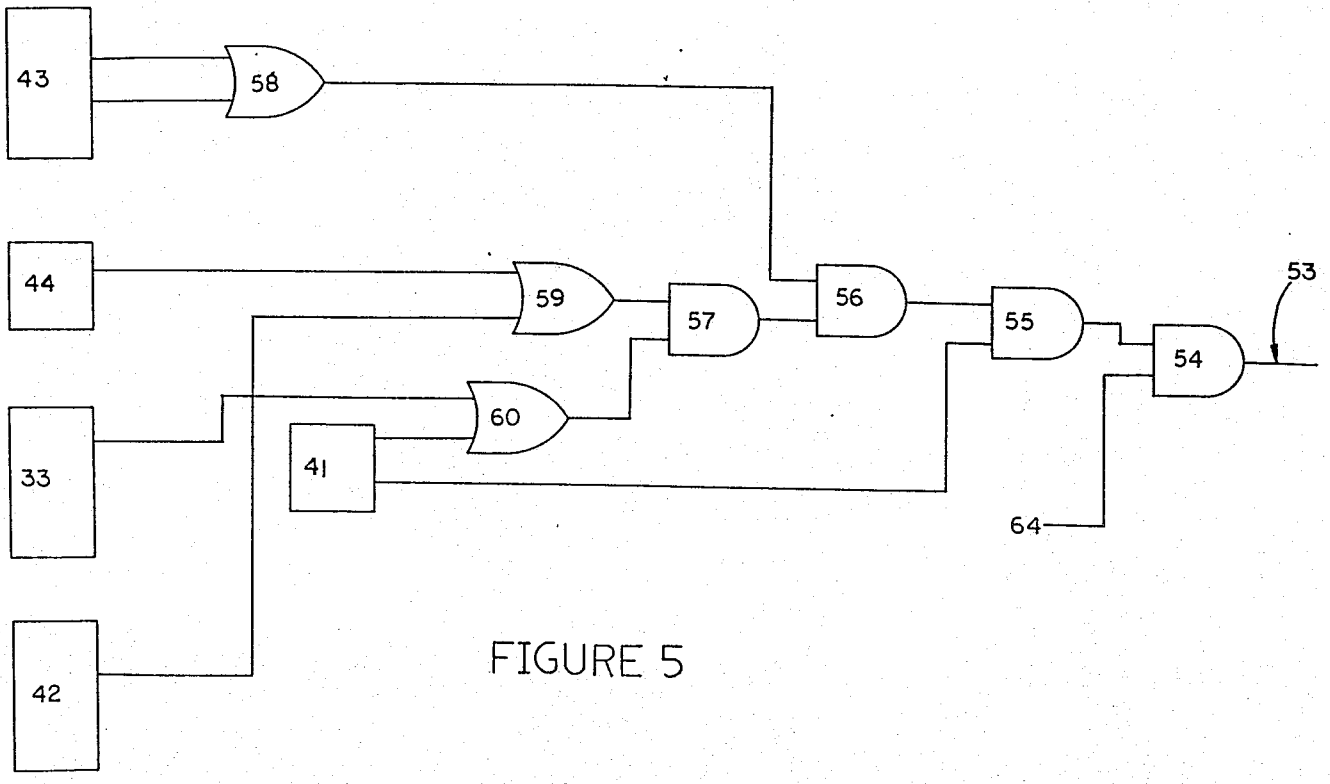
FIG. 5 is one summary example of a circuit diagram of the system control means for controlling the fuel feed means.

A positive logic output will be generated on output line 48 if or-gate 45 receives a positive output from or-gate 46 or if or-gate 45 receives a positive output from the quad comparator 41, which would indicate the temperature measured in the combustion chamber 4 exceeds approximately 120 degrees Fahrenheit, which is the 2 mV level on the quad-comparator. Or-gate 46 will generate a positive output if it either receives a positive output from timer chip 43, indicating that the electrical-arc is energized, or if it receives a positive output from or-gate 47. A positive output from or-gate 47 will be received if either the ten minute timer in timer chip 42 is operating or if the thermostat 44 is calling for more heat. FIG. 5 shows the major components of the portion of the system control means which monitors and controls the fuel feed means for the furnace and FIG. 4 shows how the output 53 from the circuit in FIG. 5 controls the energization and de-energization of the auger motor 19, which powers the furnace fuel feed means. As shown in FIG. 4, the output 53 from FIG. 5 enters the opto-isolator 61 and then the triac 62, which serve as the means for the energization and de-energization of the two terminal feed wires 63 to the fuel feed auger motor 19.

The logic circuitry shown in FIG. 5 speaks for itself as to the operation of the circuit fuel feed control means portion of the system control means. And-gate 54 will emit a positive logic signal and thereby energize the fuel feed means if the input line 64 indicates that the combustion fan is operating at a sufficient amperage level and if it receives a positive input from and-gate 55. And-gate 55 will emit a positive signal if it receives a positive signal from and-gate 56 and a positive signal from the quad-comparator 41.

The portion of the quad comparator 41 that inputs and-gate 56 will emit a positive signal so long as the milli-volt level sensed from the thermocouple 29 does not exceed 34 milli-volts, which equates to approximately 1504 degrees Fahrenheit. If the thermocouple senses temperatures over 1504 degrees, the quad comparator will send a negative or zero logic signal to and-gate 56 and automatically de-energize the auger motor 19, and hence, the fuel feed means.

Or-gate 58 will output a positive signal if the timer chip 43 indicates the furnace is operating in either the high or low burn cycle. Or-gate 59 will output a positive signal if either the thermostat 44 calls for more heat or if timer chip 42 indicates the furnace is in the 30 minute low-burn cycle.

Both the low-burn timer and the high-burn timer contained within timer chip 43 receive their signal input from an astable timer contained within timer chip 33, which continuously generates a signal approximately every four to five seconds and which is received by either the low-burn timer or the high-burn timer, which are mono-stable timers, which means they will perform their task of signal generation for the five second period and then must receive another signal from the astable timer to continue.

When the furnace is in the low-burn mode, the low-burn timer will cause the energization of the auger motor for approximately 30% of the time. When the furnace is in regular or high mode, the high-burn timer will cause the energization of the auger motor for approximately 85% of the four to five second time period between signals from the astable timer. This gives the system fuel feed means two effective fuel feed rates, depending on mode the furnace is in.

Or-gate 60 will generate a positive output if either the quad-comparator 41 indicates the temperature sensed by the thermocouple 29 is above approximately 341 degrees Fahrenheit (7.5 mV), or if timer chip 33 indicates that the electrical-arc ignition is operating.

As an additional safety feature in the event of a convection fan failure and to reduce the possibility of overheating the fuel in the fuel hopper 17, which may eventually cause a fire, there is also a conventional "snap-switch" located on the wall of the fuel hopper 17 closest to the combustion chamber 4 and in direct electrical line to the fuel feed auger motor 19, which disconnects the auger motor 19 from the power supply if the temperature on the outside wall of the fuel hopper 17 exceeds a pre-determined temperature.

Although the "snap-switch" has an automatic reset feature, the control system will not normally allow the auger motor 19 to then operate because the low temperature safety feature will not allow fuel to be fed to the fire pot 8 if the temperature measured by the thermocouple falls below that comparative level represented by the 7 mV (341 degrees Fahrenheit) comparative logic level in the quad comparator described more fully herein. From testing and experience, it generally takes approximately three minutes for the temperature at the thermocouple to fall below that minimum level. Once the temperature falls below this minimum level, and as a safety feature, manual intervention is required to re-ignite the furnace.

The ten minute combustion fan timer is activated only when the thermostat 44 goes to logic level one, thereby calling for more heat from the furnace. The combustion fan timer assures that the combustion fan remains energized and operational for a minimum of 10 minutes, regardless of what else occurs in the starting or operational system. The combustion fan timer gives our invention the added safety feature that in the event that ignition or combustion occurred, it will have sufficient air to complete combustion even if "short-cycled" for any reason. The term "short-cycled" refers to the situation where the user of the furnace moves the thermostat control to a situation calling for more heat and very soon thereafter, moves it back to a position which does not call for any more heat.

The system control means as disclosed by this invention may be accomplished by circuitry other than the preferred embodiment or by variations of the preferred embodiment set forth herein.

If the furnace is starting cold, the thermostat 44 calls for heat. The thermostat 44 is arranged in series with the system control means and closes when the room temperature is below a pre-selected value. Thermostat 44 is normally open, when no heat is required, and operates at 24 volts AC.

While the preferred embodiment for the invention has been described in detail, those familiar with the art to which this invention relates will recognize various alternative designs and embodiments for carrying out the invention as defined by the following claims.

The invention claimed is:

1. An electrical-arc ignition system which automatically ignites and automatically controls the operation of a furnace system having a fuel feed means and which burns fragmented and pelletized wood-type fuel, and which comprises:

an electrical-arc ignition means responsive to a thermostat means, including a fire pot which contains the fuel during ignition and combustion, and two electrode means configured relative to said fire pot and separated from each other by an air gap such that, when energized, an electrical-arc will occur between the two electrodes and said electrical-arc will be in a location relative to the bottom containment surface of the fire pot to contact and ignite the fuel;

said fire pot being made from material which is non-conductive, refractory material, comprising four internally sloped side-walls and a bottom surface which contains air passageways through which combustion air may be drawn;

a system control means which energizes for purposes of ignition in response to a thermostat means, and which de-energizes the electrical-arc ignition means after a pre-determined time interval of sufficient duration to ignite the selected fuel.

2. An electrical-arc ignition system as recited in claim 1, wherein the two electrode mean configured relative to the fire pot are shaped such that the closest point between the two is at a location beneath the internal bottom surface of the fire pot and such that the electrical-arc will not contact the fuel unless there is sufficient combustion air being drawn through the air passageways in the bottom internal surface of the fire pot, and the distance between the two is greater above said closest point and are configured relative to one or more of the air passageways such that the combustion air drawn through the air passageways is drawn between the two electrode means and causes the location of the arc to occur at point on the electrode means above the closest points and above the bottom internal surface of the fire pot, thereby allowing the electrical-arc to contact and ignite the fuel.

3. An electrical-arc ignition system as recited in claim 1, and which includes a system control means further comprising:

a means to de-energize the fuel feed means if the temperature in the area proximate to combustion exceeds a predetermined value, and which automatically re-energizes the fuel feed means once the measured temperature falls back within pre-determined acceptable levels;

a means to de-energize the fuel feed means if the temperature in the area proximate to combustion falls below a pre-determined value;

a temperature measurement means to measure temperature within the area of the combustion.

4. An electrical-arc ignition means as recited in claim 1 or in claim 3, and which further includes a system control means comprising:

a system control means which sequences the operation of the elements of the electrical-arc ignition means and a temperature measuring means that will de-energize the electrical-arc ignition means and the fuel feed means at a pre-determined time interval if the temperature in the furnace has not yet reached a pre-selected value.

5. An electrical-arc ignition system as recited in claim 1 or in claim 3, and which includes a system control means which further comprises:

a means to measure the amperage provided to a furnace combustion fan and which de-energizes the fuel feed means if the combustion fan is not operating at a sufficient pre-determined level to achieve efficient combustion or sufficient transfer of heat from the combustion area.

* * * * *